US005331926A

United States Patent [19]

Vaux et al.

[11] Patent Number: 5,331,926

[45] Date of Patent: Jul. 26, 1994

[54] DWELLING SCOTCH YOKE ENGINE

[75] Inventors: Melvin A. Vaux, Kingman, Ariz.; Thomas R. Denner, Clark County, Nev.

[73] Assignee: Denner, Inc., Las Vegas, Nev.

[21] Appl. No.: 96,790

[22] Filed: Jul. 23, 1993

[51] Int. Cl.[5] ..... F02B 75/24

[52] U.S. Cl. ..... 123/56 BC; 123/56 C; 123/196 R; 123/197.4

[58] Field of Search ..... 123/197.3, 197.4, 56 R, 123/56 B, 56 BC, 56 C, 196 R

[56] References Cited

U.S. PATENT DOCUMENTS

| | | | |
|---|---|---|---|
| 399,593 | 3/1889 | Worth | 123/56 C |
| 2,513,514 | 7/1950 | Poage | 123/56 BC |
| 4,459,945 | 7/1984 | Chatfield | 123/56 C |

FOREIGN PATENT DOCUMENTS 413599 4/1910 France .

*Primary Examiner*—Noah P. Kamen
*Attorney, Agent, or Firm*—James D. Hall

[57] ABSTRACT

An improved engine utilizing a dwelling scotch yoke and a journalled flywheel in a unique combination for stalling the translatory movement of oppositely paired pistons during the detonation of the fuel mixture to achieve a clean exhaust and a energy efficient engine.

18 Claims, 7 Drawing Sheets

Fig.5
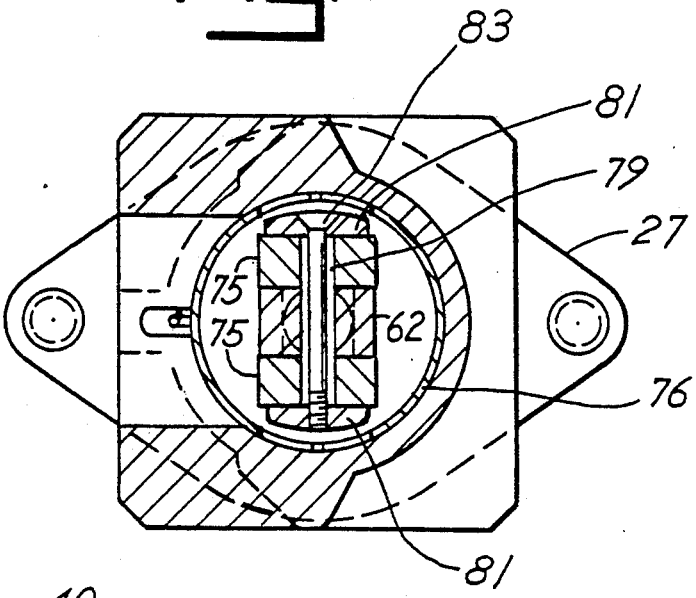
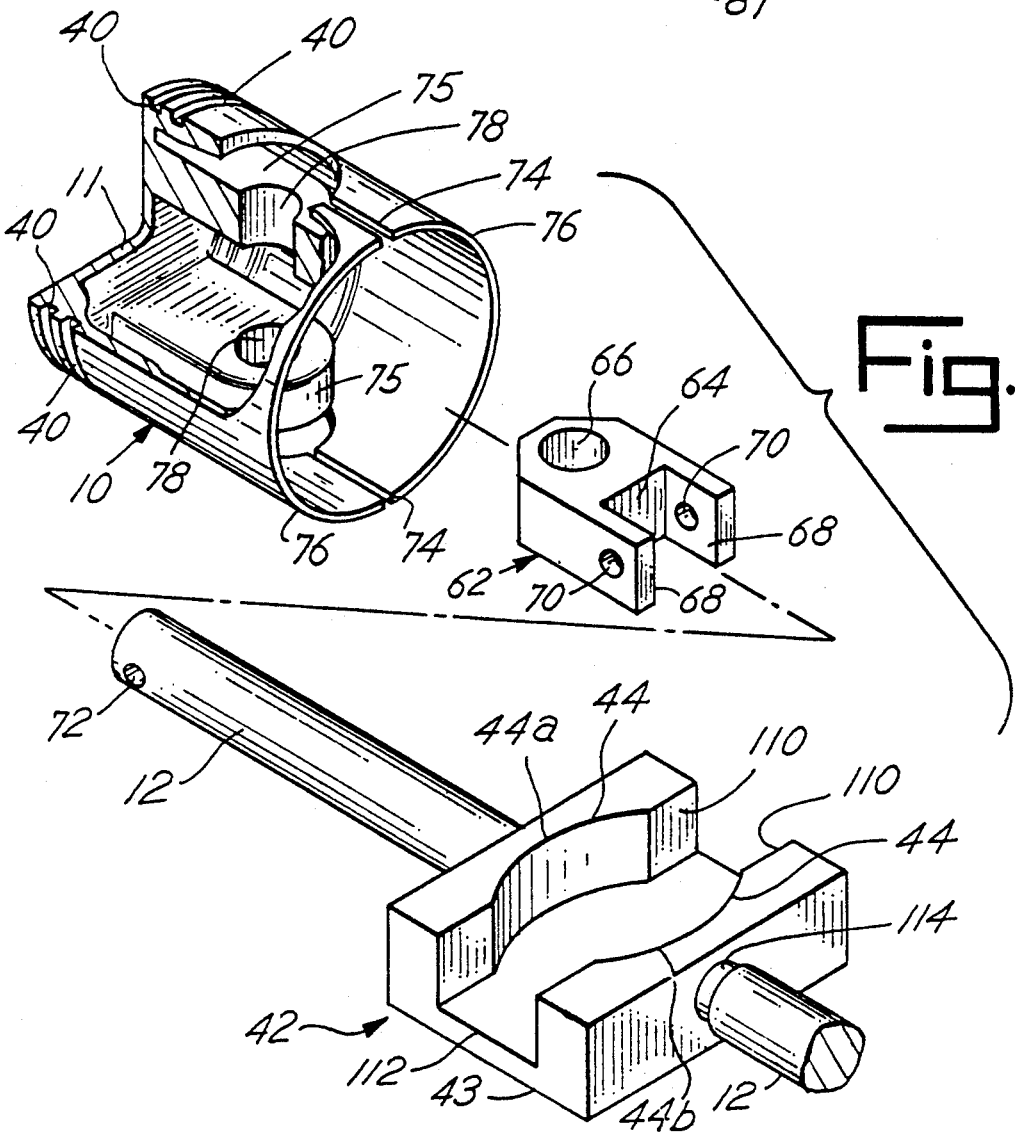
Fig.6

DWELLING SCOTCH YOKE ENGINE

SUMMARY OF THE INVENTION

This invention relates to an improved engine, and will have special application, but not necessarily so limited, to internal combustion engines which can be used in lawn mowers to diesel electricity generators.

The engine embodied in this invention utilizes a dwelling scotch yoke and a journalled flywheel in a unique combination for stalling the translatory movement of oppositely paired pistons during the detonation of lean fuel mixture. A fixed volume is thus maintained above the piston during detonation, in which a complete chemical reaction of the fuel molecules and the rich air can occur. Consequently, the fuel mixture can be disassociated into its purer elements to achieve a very clean exhaust and a highly energy efficient engine.

An additional feature of this engine is that it is compact and efficient in size and maintenance. The journalled flywheel obviates the use of a crankshaft and throws typically used in two and four cylinder engines. Further, the flywheel functions as an oil pump for supplying lubrication to the pistons. Each of the pistons have flared skirts to allow for better engine lubrication and to reduce heat warping, thus reducing wear.

The engine also utilizes cylinders with sealed end walls. The cylinder bore by being enclosed at its lower end is separated from the crankcase internal chamber where the journalled flywheel and oil bath is located. The presence of the cylinder end wall functions to provide a barrier between the cylinder bore and the oil bath and also to allow for an increase in the density of the fuel mixture during piston movement. By increasing the density of the fuel mixture, it is more efficiently burned during the detonation process.

Still another feature of the cylinder is the location and size of its exhaust ports. The exhaust ports are located such that the exhaust gases generated within the cylinder are not released until the piston completes its inward or power stroke. Thus, a longer power stroke is achieved resulting in increased horsepower than can be gained using conventional cylinders.

Accordingly, an object of this invention is to provide an energy efficient engine.

Another object of this invention is to provide an engine that produces environmentally favorable exhaust.

Still another object of this invention is to provide an engine that can operate by burning various forms of fuels.

Still another object is to provide an engine that is compact, lightweight, durable, easily assembled, and economical.

Other objects will become apparent upon a reading of the following description.

BRIEF DESCRIPTION OF THE DRAWINGS

A preferred embodiment of the invention has been depicted for illustrative purposes only wherein:

FIG. 5 is a cross-sectional view of a cylinder and piston taken along line 5—5 of FIG. 4.

FIG. 6 is a perspective view of the piston, saddle and yoke components of the invention showing the piston in partial sectionalized form for illustrative purposes.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

The preferred embodiment of the invention is a four-cylinder, two-stroke engine. The concepts that exist in this invention are applicable to other types of engines such as multiple-cylinder, four-stroke engines.

Figure 1:
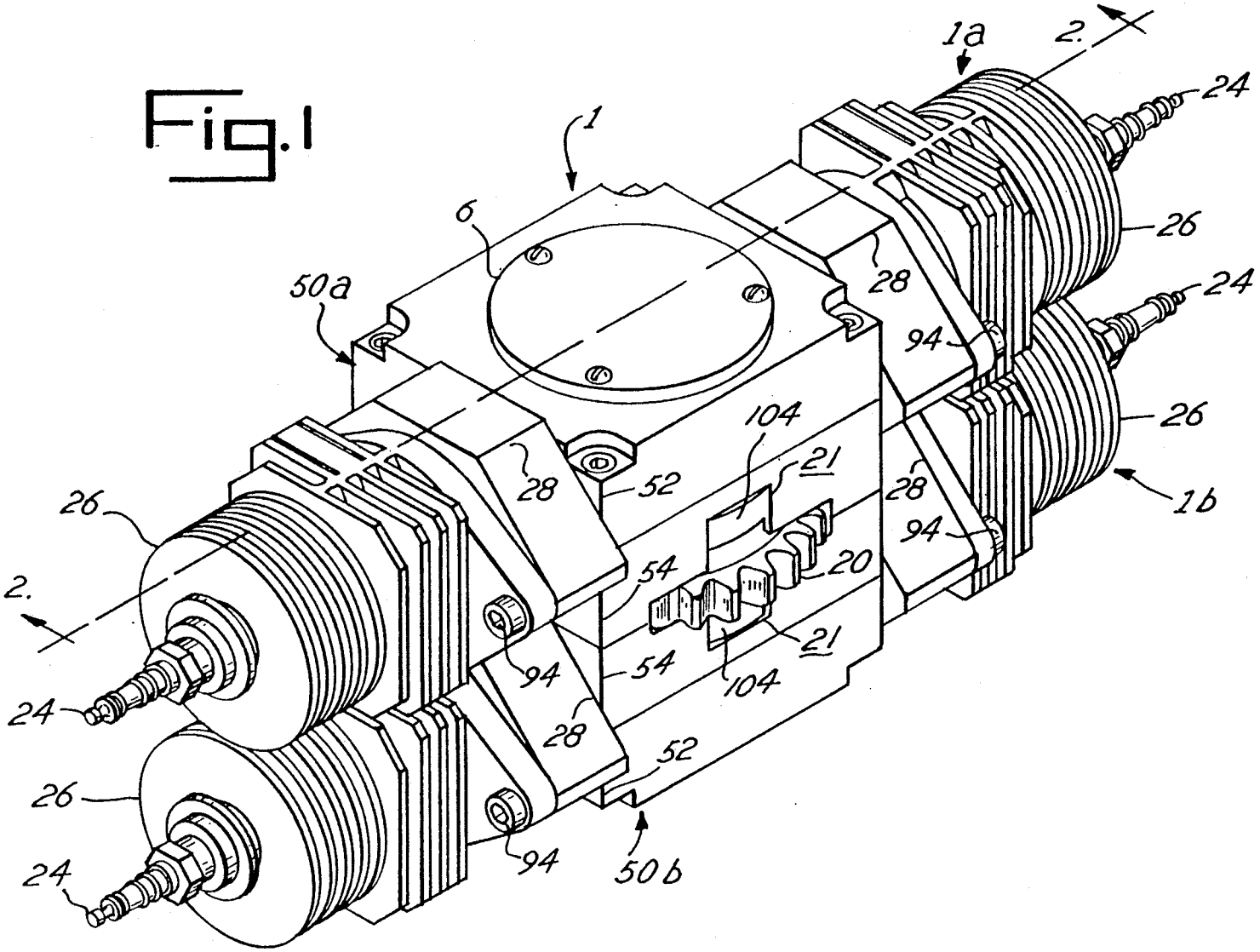
FIG. 1 is a perspective view of the invention.

Referring now to the drawings, FIG. 1 illustrates the preferred embodiment of the twin-opposing four--cylinder, two-stroke internal combustion engine 1. For descriptive purposes, engine I can be referred to as having similar halves sharing a flywheel 20. Thus, only one such engine half will be described in detail with similar reference numerals being used for like functioning components of both halves.

Figure 2:
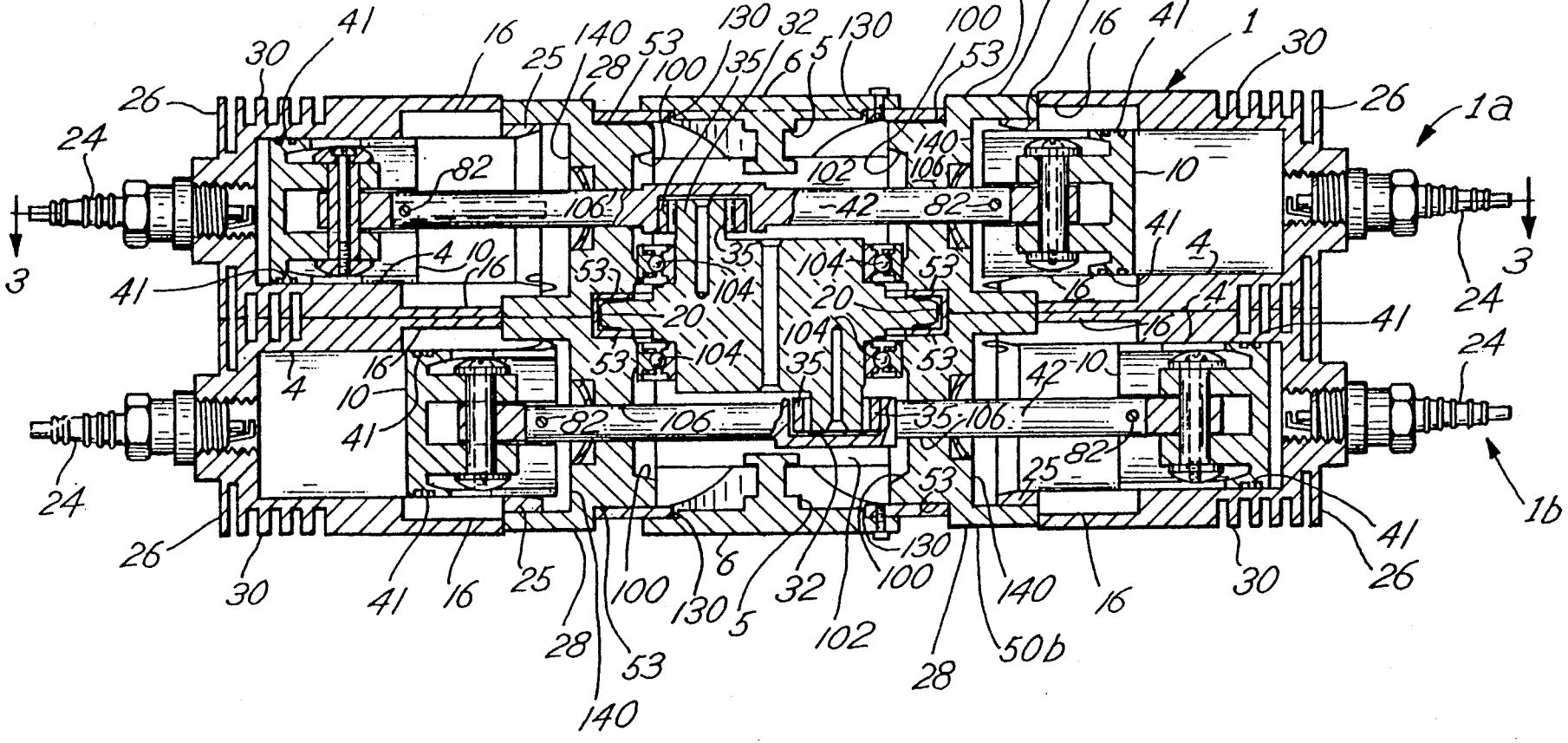
FIG. 2 is a longitudinal-sectional view taken along line 2—2 of FIG. 1 showing the invention from the side.

Each engine half la, lb includes a pair of oppositely located pistons 10, a cylinder 26 for each piston 10, and a portion of a crankcase 50 supporting a journalled flywheel 20 therein. Each crankcase half 50*a*, 50*b* includes an outer part 52 and an inner part 54 forming in conjunction with the other crankcase half a central chamber 102 for the internal components of engine 1. Outer part 52 and inner part 54 are fastened to other crankcase half by screws 94. Crankcase 50 supports a journalled flywheel 20 in central chamber 102 by a bearing 104. Bearing 104 is seated in the cavity defined by inner parts 54 so as to support flywheel 20 and allow it to rotate about an axis perpendicular to the piston movement. Crankcase 50 has a side opening 21 for a sectored portion of flywheel 20 to mesh with a suitable power input gear (not shown). Additionally, outer part 52 and inner part 54 form in conjunction the openings 53 for interfitting cylinder neck parts 28, as shown in FIG. 2.

Figure 14:
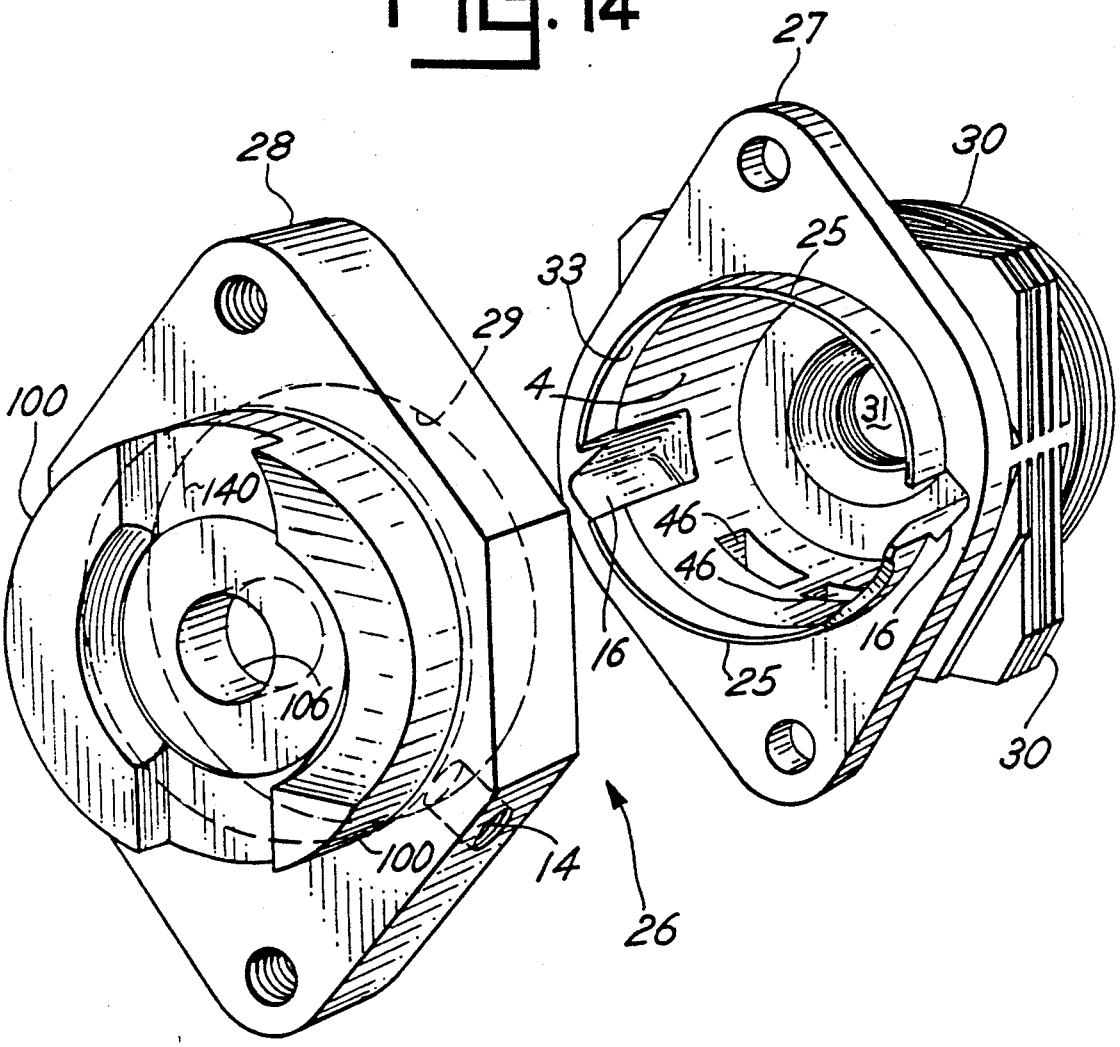
FIG. 14 is an exploded perspective view of the cylinder head and neck, illustrating the exhaust ports, the transfer ports, the inlet port, the spark plug hole in the cylinder bore of the cylinder head and the through hole for the connecting rod in the cylinder neck.

As shown in FIG. 14, each cylinder 26 includes a head part 27 and a neck part 28. Each head part 27 includes top opening 31 for an interfitting spark plug 24, a lower annular lip 25 for interfitting with neck part 28 and which defines an opening 33 which is part of the cylinder bore 4, two exhaust ports 46 for allowing the discharge of the exhaust gases out of cylinder bore 4, diametrically located transfer ports 16 for allowing the passage of the fuel mixture from below the piston to above the piston and cooling flanges 30 for dissipating the heat generated within the head part, all as shown in FIG. 14. Each neck part 28 has an annular recess 29 for accepting head part lip 25, an inlet port 14 for allowing the passage of the fuel mixture into the cylinder bore 4 below the piston, and necked collar part 100 for fitting into crankcase opening 53.

Each cylinder 26 contains a piston 10 located in bore 4. Each piston 10 includes a skirt 76 with opposing slots 74 and circumferential grooves 40, as shown in FIG. 6. Slots 74 are for reducing the effects of heat warping upon each piston 10 and to allow skirt 76 to flare outwardly into contact with cylinder bore 4 so as to achieve a greater vacuum below the piston during engine operation. Rings 41 are carried in grooves 40. The length of each piston 10 is preferably longer than the length of transfer ports 16.

The pair of pistons 10 are coaxially interconnected by a yoke 42. Each piston 10 includes opposing lugs 75 which extend from the piston top wall 11 spacedly along the interior of skirt wall 76, as shown in FIG. 6. Lugs 75 have aligned holes 78. As shown in FIG. 5, a hollow retainer pin 79 extends into each hole 78. Retainer pin 79 is held within piston 10 by a pair of washers 81 each placed over one end of the pin and is secured by a retainer screw 83 which extends through the hollow pin. A saddle 62 is pivotally carried between lugs 75 by retainer pin 79 inserted with clearance through the saddle piston hole 66. Saddle 62 has aligned wrist pin holes 70. Wrist pin 82 extends into each hole 70 and is held by a screw connection. A rod 12 is pivotally carried between the saddle walls 68 by wrist pins 82 inserted with clearance through the rod wrist pin hole 72. The end of rod 12 abuts against the saddle seat 64 for ensuring no longitudinal loading is experienced by wrist pin 82 or skirt 76 during the power stroke of pistons 10. Clearance exists between rod 12 and saddle walls 68 for allowing lateral movement of piston 10 relative to rod 12 so as to achieve uniform piston wear. The oppositely aligned ends of rods 12 coaxially join a U-shaped cam member 43 to form yoke 42. Cam member 43 is located in internal chamber 102. Each rod 12 extends from internal chamber 102 through the lower end wall 140, in which a hole 106 is provided in each neck part 28, and into cylinder bore 4.

Each cam member 43 includes two side walls 110 and a back wall 112. Each side wall 110 defines an involuted cam or dwell cup 44, as shown in FIG. 6, herein described later. The center of each dwell cup 44 is referred to as either top dead center **44*a* or bottom dead center 44*b*. This nomenclature is relative to the position of each individual piston 10. For some applications of engine 1, dwell cups 44 can have varying curvatures as required to gain the desired engine efficiency during fuel detonation. This may be achieved by using an insert a shoe (not shown) in cam member 43 that has the desired shape of dwell cups 44. In this preferred embodiment dwell cups 44 have symmetrical curvatures. Back wall 112 of cam member 43 can be adapted for imparting auxiliary motion to a second machine through a suitable capped opening 130 in crank case 50**.

Each yoke 42 is connected to flywheel 20 through a cam follower 32, as shown in FIG. 2. Cam followers 32 form a part of flywheel 20 and are diametrically located on opposite sides of the flywheel within chamber 102. The contact surface of each cam follower 32 is in the form of a bearing 35. Each cam follower 32 fits with rolling clearance between side walls 110 of cam member 43.

Figure 3:
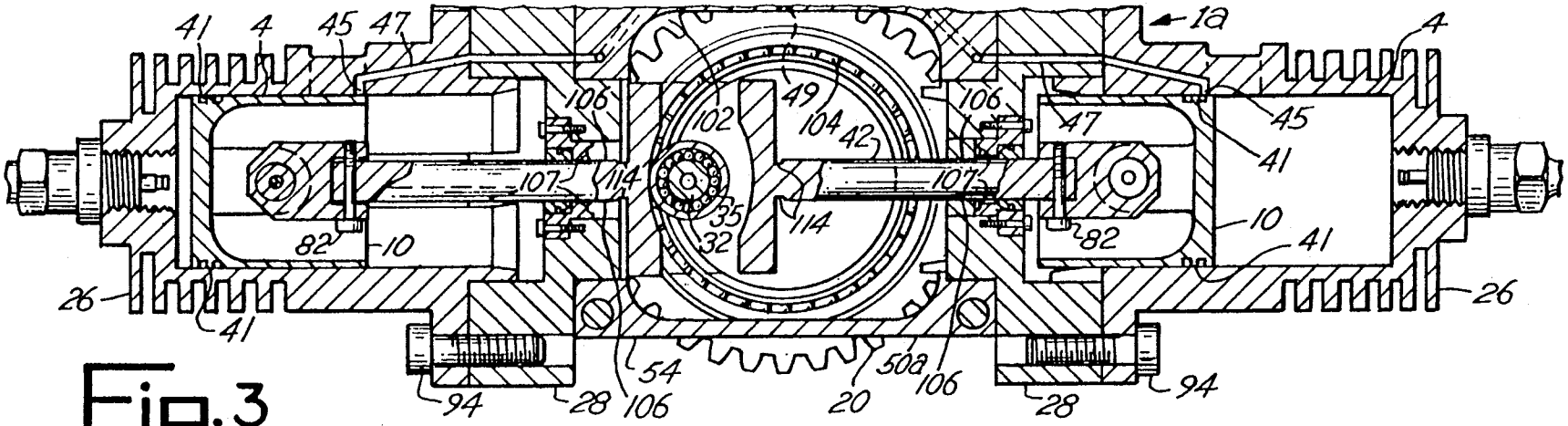
FIG. 3 is a longitudinal-sectional view taken along line 3—3 of FIG. 2 showing the invention from the top.
Figure 4:
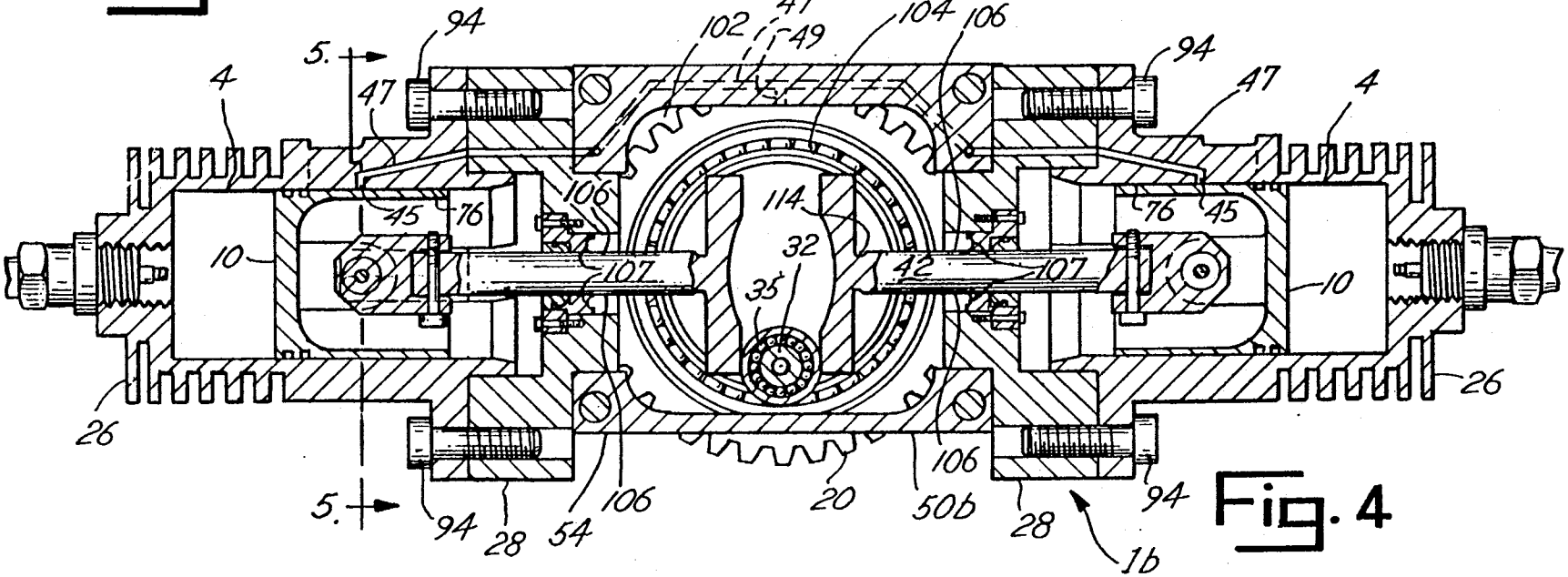
FIG. 4 is a longitudinal-sectional view like FIG. 3, but showing the engine configuration in another operative position.
Figure 7:
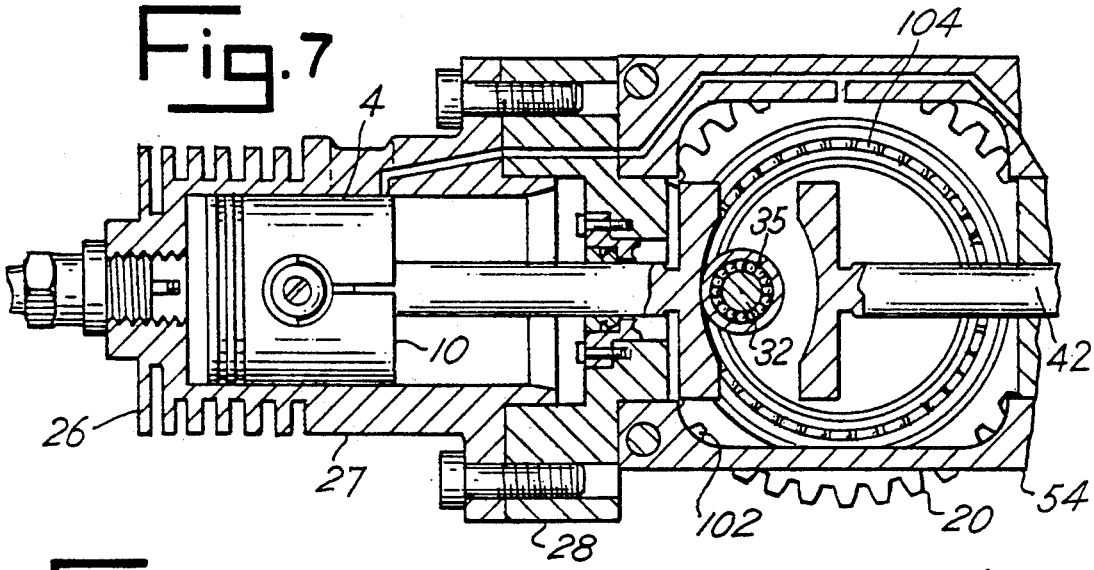
FIG. 7 is a sectional view of a cylinder with the piston at its top and the cam follower at zero degrees or top dead center.

Lubricating oil is placed in chamber 102 for reducing friction wear of the engine components during operation. An oil passage 47 is provided in each inner part 54, connected to neck part 27 and head part 27. Passage begins at an inlet port 49 within internal chamber 102 and terminating in an outlet port 45 located in each cylinder bore 4, as shown in FIG. 4. Each outlet port 45 is located so piston rings 41 are lubricated as piston 10 reaches the bottom of its stroke, as shown in FIG. 3. During the operation of engine 1, the movement of the internal components located in crankcase 50 act as a pump forcing the oil in chamber 102 into inlet port 49, along passage 47, out each port 45 and onto rings 41. Negative pressure created from piston 10 movement aids in drawing the oil onto rings 41. The flaring of piston skirt 76 serves to obstruct the release of oil into bore 4 when rings 41 are not in contact with inlet port 45.

Each yoke rod 12 is necked at the cam member junction 114 for preventing oil in chamber 102 from being injected into cylinder bore 4 through opening 106 during engine 1 operation. A seal 107 is located at opening 106 of each neck 28 and extends about rod 12 to also assists in obstructing oil from being pumped into cylinder bore 4. Cylinder bore 4 is also sealed at its innermost end by its neck part 28.

In the operation of engine 1, pistons 10 act in concert to rotate flywheel 20 by means of yokes 42. Each yoke 42 serves to translate the longitudinal coaxial motion of each pair of opposed pistons 10 into rotational movement of flywheel 20. This occurs when a piston 10 moves down cylinder bore 4 thereby pushing yoke 42 along its longitudinal axis. As each yoke 42 is moved it carries with it the connected cam follower 32, thus causing flywheel 20 to rotate. Flywheel 20 will rotate 360° about its axis as each yoke 42 is pushed down and back.

Figure 10:
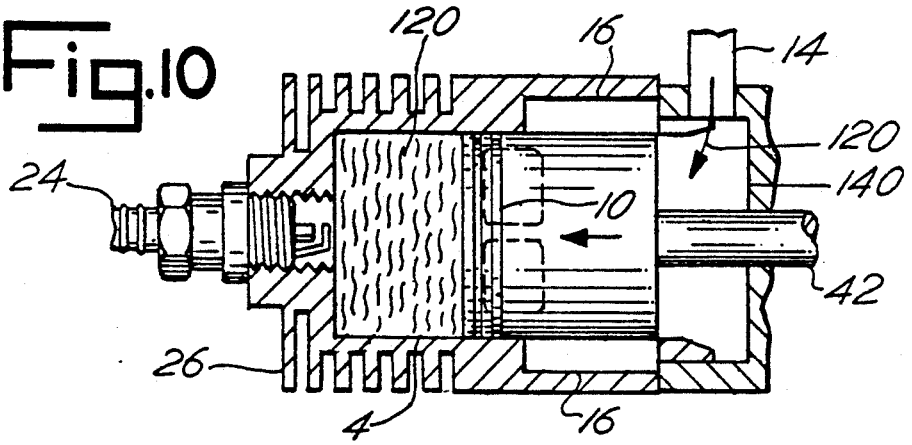
FIG. 10 is a sectional view of the fuel being drawn into the cylinder as the piston begins its upward movement while compressing the fuel mixture already above the cylinder.
Figure 11:
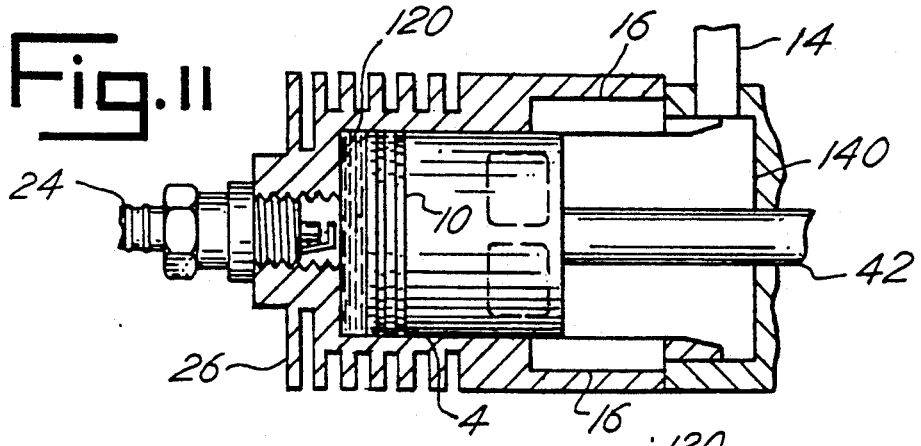
FIG. 11 is a sectional view of the piston at the top of the cylinder and the fuel mixture compressed prior to detonation.
Figure 12:
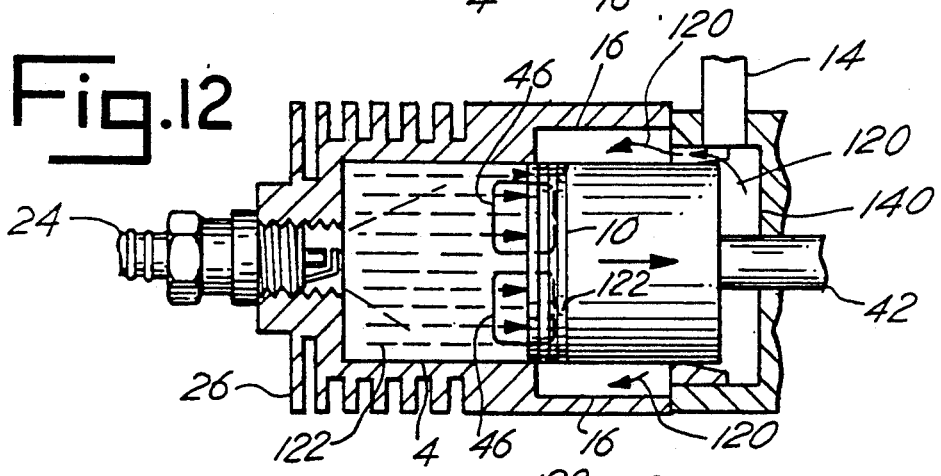
FIG. 12 is a sectional view of the fuel mixture detonated forcing the piston downward, opening the exhaust port to allow the exhaust gases to escape while also forcing the fuel mixture below the piston into the transfer ports.
Figure 13:
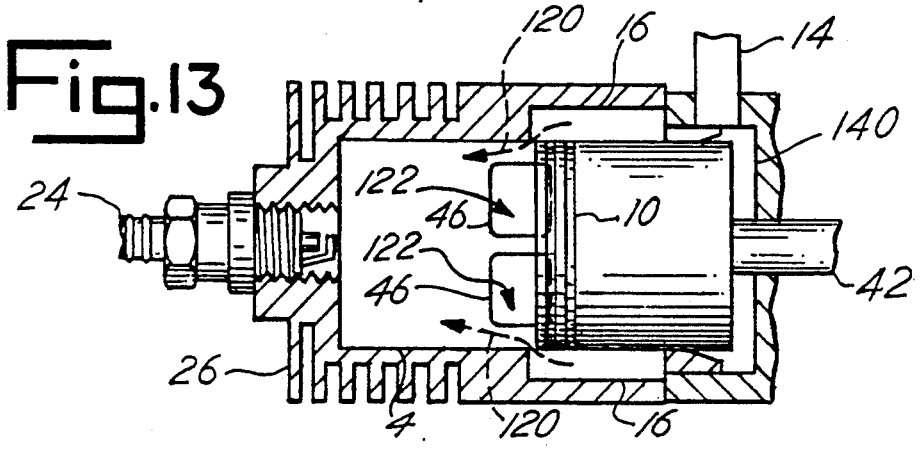
FIG. 13 is a sectional view of the piston at the bottom of the cylinder and the transfer port opened to release the fuel mixture into the upper cylinder chamber, and expel any remaining exhaust gases out the exhaust port.

Piston 10 movement occurs upon the detonation of a fuel mixture 120 in cylinder 26. Fuel mixture 120 cycles through each cylinder bore 4 in the following manner. The first outward stroke of each piston 10 causes a negative pressure below the piston to draw fuel mixture 120 from inlet port 14 into cylinder bore 4, as shown in FIG. 10. The following inward stroke of piston 10 forces fuel mixture 120 from below the piston into transfer ports 16, as shown in FIG. 12. When piston 10 reaches the bottom of cylinder bore 4, transfer ports 16 open above the piston and allows the pressurized fuel mixture 120 to flow into the area above the piston, as shown in FIG. 13. The succeeding outward stroke of piston 10 further compresses fuel mixture 120 above the piston, as shown in FIG. 11. When piston 10 reaches the top of cylinder bore 4, fuel mixture 120 is detonated by a spark from sparkplug 24. The subsequent explosion causes piston 10 to move inwardly; this motion is commonly referred to as the power stroke. As piston 10 reaches the bottom of cylinder bore 4 during its power stroke, exhaust ports 46 open to allow the burnt or exhaust gases 122 to expand and flow out of cylinder bore 4 through exhaust ports 46, clearing it to receive nearly simultaneously a fresh charge of fuel mixture 120, as shown in FIG. 13. The cycle is then repeated.

The presence of dwell cups 44 in yokes 42 increases the engine's horsepower by regulating the movement of pistons 10. The outward movement of each piston 10 is substantially stopped when its associated cam follower 32 travels along the concave surface of dwell cup 44 during the power stroke of its oppositely located, paired piston. By stopping piston movement at the top its compression/detonation stroke, fuel mixture 120 is compressed into a fixed volume and can experience a substantively complete burn before the piston moves and enters its power or inward stroke. Further, hydrocarbons or nitrous oxides are reduced and sometimes even eliminated from exhaust gases 122, because the fuel mixture 120 is more thoroughly consumed. Thus, contamination of subsequent fresh charges fuel mixture 120 entering into cylinder bore 4 by unburned hydrocarbons will be reduced and perhaps even eliminated.

Figure 8:
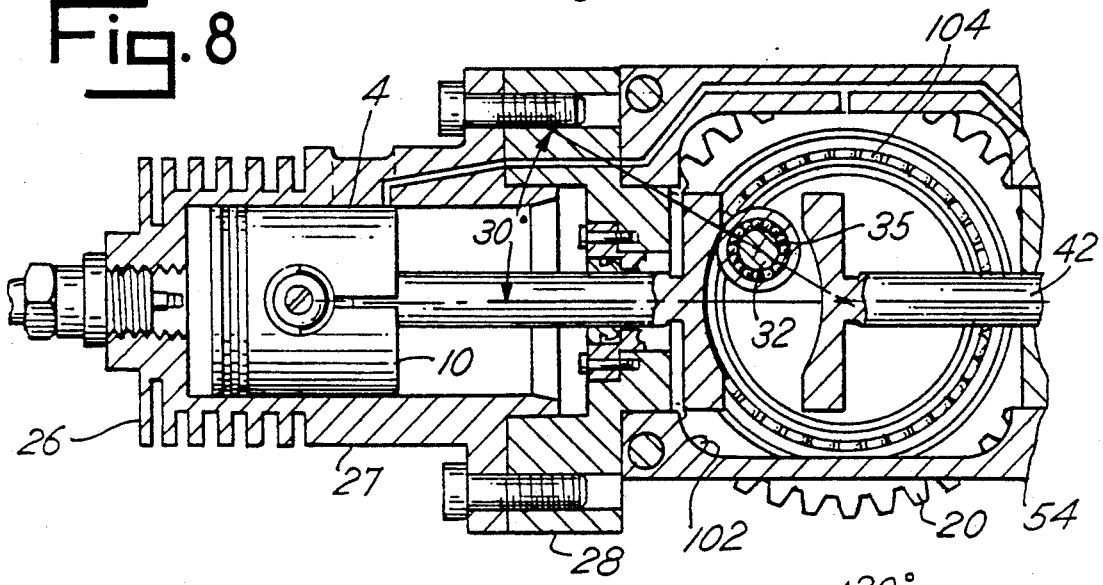
FIG. 8 is a sectional view showing the cam follower at 30°.
Figure 9:
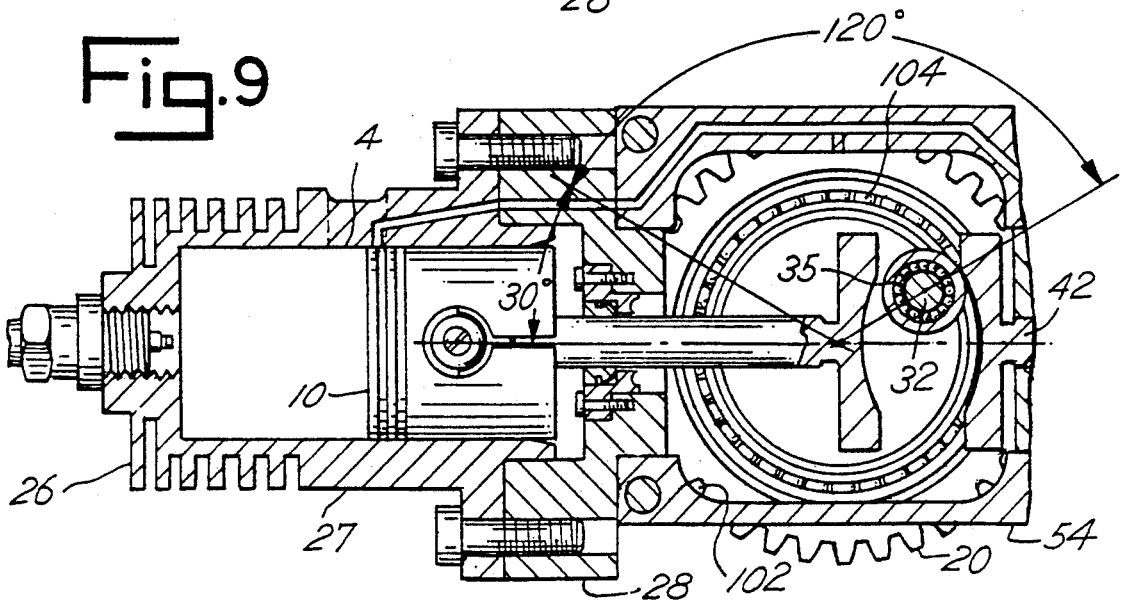
FIG. 9 is a sectional view showing the cam follower at 150°, illustrating that the cam follower travels 120° between the opposing involuted cams or dwell cups during the power stroke of the piston.

This process begins when each cam follower 32 reaches the cam or concave surface of its associated top dwell cup 44*a* at −30° There, fuel mixture 120 is ignited. For 60° of rotation, cam follower 32 travels along the dwell cup surface which is curved to match the radial sectored movement of the cam follower, stopping the movement of piston 10 while fuel mixture 120 is consumed. At +30°, piston 10 begins its power stroke, as shown in FIG. 8. The expansive forces created from the detonation of fuel mixture 120 moves piston 10 inward, pushing yoke 42 against cam follower 32 which turns flywheel 20. When cam follower 32 reaches 150°, it begins to travel along the bottom dwell cup 44*b*, as shown in FIG. 9. Piston 10 will again be substantially stopped in movement for 60° until cam follower 32 reaches 210°. This allows the detonation process to occur in the opposite cylinder 26. Piston 10 then begins its succeeding outward stroke once cam follower 32 reaches 210° and is forced out along cylinder bore 4 into its compression/detonation stroke by the connected opposite paired piston 10 which is being forced inward during its own power stroke.

Each pair of pistons 10 has two power strokes (one for each piston) per revolution of flywheel 20. Each piston pair operate in synchronous translation and 180° out of phase with the other pair of pistons. Thus, fuel mixture detonation occurs at each piston 10 in its outermost position simultaneously. Hence, the outermost piston 10 of one piston pair will be in its power stroke as the offset oppositely located outward piston 10 of the other piston pair is also in its power stroke, and in concert, the two pistons will function to rotate flywheel 20.

The presence of cylinder end wall 140 also serves to maximize engine's 1 creatable horsepower by increasing the density of fuel mixture 120. Because cylinder bore is enclosed at its lower end and thus separated from internal chamber 102, fuel mixture 120 achieves a greater density when being compressed into transfer ports 16 than conventional engines. Thus, when fuel mixture 120 is consumed, the increase in density equates to an increase in generated power. The thickness of cylinder end wall 140 thickness can be varied by installing specially machined neck parts 28 so as to alter the fuel mixture density as desired.

The location and size of exhaust ports 46 serves to maximize the amount of horsepower piston 10 can generate during its power stroke. Exhaust ports 46 are positioned to open when the opposite paired piston 10 begins detonation. Thus, a longer power stroke is achieved resulting in increased horsepower than can be gained using conventional cylinders.

During operation of engine 1, noise generated by yoke 42 impacting against cam follower 32 is reduced because of the presence of dwell cups 44. Also during the operation of engine 1, yoke 42 may have a tendency to rotate about the longitudinal axis during translation. An I-beam 5 is fastened to each crankcase cover 6 so as to prevent such rotation.

It is understood that the above description does not limit the invention to the details given, but may be modified within the scope of the following claims.

I claim:

1. An engine comprising a housing which includes a central crank case having a chamber therein and two oppositely located cylinders, one of said cylinder on each side of said crank case with said crank case chamber therebetween, a piston shiftably supported in each cylinder, a yoke connected between said pistons and extending through said crank case chamber, said yoke being shiftable between first and second reciprocal positions within said crank case chamber upon alternating movement of said pistons within said cylinders, a flywheel journalled in said crank case chamber, means carried by said flywheel accessible from a crank case opening for imparting driving power to a power input mechanism during flywheel rotation, said yoke including a cam member located generally centrally between said pistons, said flywheel including means engaging said yoke cam member for imparting rotation to the flywheel upon movement of said yoke between its said first and second positions, said yoke cam member having camming means contacting said flywheel means for imparting controlled movement to each piston during fuel detonation within its said cylinder, and means for detonating said fuel within each cylinder.

2. The engine of claim 1 wherein said yoke cam member includes opposing side walls, said flywheel means being a protruding follower positioned between said side walls, each side wall having a generally undulate shape, said follower contacting one said of side walls when said yoke is in said first position and contacting the other of said side walls when said yoke is in said second position.

3. The engine of claim 2 wherein each side wall includes a centered arcuate concave sector having a radius of curvature approximating the radius of movement of said follower upon rotation of said flywheel.

4. The engine of claim I wherein said yoke cam member includes a wall part connecting said side walls.

5. The engine of claim I wherein said yoke includes coaxial rods extending in opposite directions from said yoke cam member, each piston connected by a saddle to one end of said rod, each rod secured by a wrist pin to a said saddle in abutting contact with said saddle.

6. The engine of claim 5 wherein each piston includes an end wall and an extending skirt, a pair of spaced lugs extending from said piston end wall, said saddle positioned between and pivotally secured to said lugs, said lugs being separated from said skirt.

7. The engine of claim 6 wherein each skirt flares outwardly from said piston end wall.

8. The engine of claim 7 wherein each said skirt includes an end edge and a slit extending from said end edge towards said piston end wall, each cylinder having a bore with side, a said piston located in each cylinder bore with its said skirt at said slit end edge contacting said cylinder bore side.

9. The engine of claim 1 wherein each cylinder includes a bore defined by opposing end walls and a connecting side wall, said piston located within each cylinder bore, said yoke including a rod extending in a sealed relationship through one of said bore end walls.

10. The engine of claim 9 wherein said housing has a passage extending within said crank case and each cylinder from said crank case chamber into each cylinder bore, said passage constituting means for directing oil from a reservoir in said crank case chamber to each piston.

11. The engine of claim 10 and including pump means within said crank case chamber for forcing said oil into said passage.

12. The engine of claim 11 wherein said pump means includes said yoke and said flywheel.

13. The engine of claim 9 wherein each of said cylinder bores includes a fuel inlet port located adjacent said one bore end wall between said piston end wall and said one cylinder bore end wall, means for conducting said fuel from said cylinder bore between said piston and said one cylindrical bore end wall to between the piston and the other said bore end wall, and an exhaust port located in said bore side wall between said piston and said other bore end wall when the piston is nearest said one bore end wall.

14. The engine of claim 9 wherein each said cylinder includes separable neck and head parts, each neck part including said one bore end wall and being detachably connected between said head part and said crank case.

15. An engine comprising a housing which includes a central crank case having a chamber therein and two pairs of oppositely located parallel cylinders, one of said cylinders of each pair located on each side of said crank case with said crank case chamber therebetween, a piston shiftably supported in each cylinder forming aligned pistons for each pair of cylinders, a yoke connected between said aligned pistons and extending through said crank case chamber, each yoke being shiftable between first and second reciprocal positions with said crank case chamber upon alternating movement of said aligned pistons within their respective cylinders, a flywheel journalled within said crank case chamber, means carried by said flywheel accessible from a crank case opening for imparting driving power through a power input mechanism during flywheel rotation, each said yoke including a cam member located generally centrally between said aligned pistons, said flywheel including means engaging said yoke cam member of each yoke for imparting rotation to the flywheel upon movement of each yoke between its said first and second positions, each yoke cam member of a said yoke including camming means contacting said flywheel means for imparting controlled movement to each said piston connected to said yoke prior to the commencement of the power stroke of the piston.

16. The engine of claim 14 wherein each yoke cam member includes opposing spaced side walls, said flywheel means having diametrically positioned and oppositely protruding followers, each follower positioned between said side walls of said yoke cam member.

17. The engine of claim 15 wherein each side wall of each said yoke cam member has a generally undulant shape, said follower being positioned between said side walls of said yoke cam member and contacting one of such said side walls when said yoke is in said first position and contacting another said side wall when said yoke is in said second position.

18. The engine of claim 16 wherein each said yoke cam member side wall includes a centered arcuate concave sector having a radius of curvature approximating the radius of movement of its contacting follower upon rotation of said flywheel.

* * * * *